US005114209A

United States Patent [19]

Dunn

[11] Patent Number: 5,114,209

[45] Date of Patent: May 19, 1992

[54] CHAIR INSERT HAVING A CONTOURED BACK SUPPORT PORTION AND A SEAT SUPPORT PORTION

[76] Inventor: John C. Dunn, 4621 Autumnwoods Way, Tallahassee, Fla. 32303

[21] Appl. No.: 496,661

[22] Filed: Mar. 21, 1990

[51] Int. Cl.[5] ..... A47C 7/02

[52] U.S. Cl. ..... 297/231; 297/456

[58] Field of Search ..... 297/460, 232, 231, 454, 297/455, 456, 239, 230; 5/433, 432

[56] References Cited

U.S. PATENT DOCUMENTS

| | | | |
|---|---|---|---|
| 2,853,124 | 9/1958 | Shapiro | 297/456 |
| 2,855,986 | 10/1958 | Engelen, Sr. | 297/460 |
| 3,265,437 | 8/1966 | Mincieli | 297/231 |
| 3,361,471 | 1/1968 | Radford | 297/460 |
| 3,511,537 | 5/1970 | Ackermann | 297/454 |
| 3,953,072 | 9/1976 | Esquivel | 297/231 |
| 4,753,482 | 6/1988 | Warren | 297/460 |
| 4,810,034 | 3/1989 | Beier | 297/231 |
| 4,824,169 | 4/1989 | Jarrell | 297/230 |

FOREIGN PATENT DOCUMENTS

| | | | |
|---|---|---|---|
| 3544094 | 6/1987 | Fed. Rep. of Germany | 297/460 |
| 1373267 | of 1964 | France | 297/460 |

*Primary Examiner*—Kenneth J. Dorner
*Assistant Examiner*—James M. Gardner
*Attorney, Agent, or Firm*—Macdonald J. Wiggins

[57] ABSTRACT

An insert for a chair includes a seat portion and a back portion, and is molded from dense firm rubber, or the like. The seat portion tapers from a front edge to the rear such that the upper surface is essentially parallel with the floor when the insert is installed on the chair. The back portion includes a lower concave front surface fitting the gluteal region of the pelvis, a central convex portion fitting the lumbar curve, and an upper concave portion matching the thoraic kyphotic curve. The use of the insert maintains the user's spine in a natural postion that places the center of gravity of the head over the vertical axis of the spine.

14 Claims, 2 Drawing Sheets

CHAIR INSERT HAVING A CONTOURED BACK SUPPORT PORTION AND A SEAT SUPPORT PORTION

BACKGROUND OF THE INVENTION

1. Field of the Invention

The present invention relates to chair seat and back insert devices, and more particularly to a chair insert back support that positions the user's head and spine aligned with the spine.

2. Description of the Prior Art

Back pain is prevalent in society and often results from relatively minor accidents, constant pushing, pulling, lifting, slipping or falling, or vibrations. Much of such pain occurs in the lower back area. In addition to the suffering of individuals, the cost to society through insurance claims, loss of productivity, and medical care of back pain is extremely high. Back pain often is due to segmental dysfunctions when vertebral joints do not move properly due to misalignment or other causes. Treatment of this type of pain requires returning the spinal column to its normal alignment.

In a normal person, the spine, viewed from the front, forms a straight vertical line, and supports the body from the waist up. The cervical spine, or neck portion, curves forward into a smooth, flexible "C", and supports the head which is about 7% of the body weight. The thoraic spine, or middle back, curves in the opposite direction from the cervical spine, supporting the rib cage and upper body. The ribs prevent the thoraic spine from being very flexible. The lumbar spine, or lower back, curves forward in a flexible "C" in the opposite direction. The fourth and bottom curve is the stable curve formed by the sacral and coccygeal part of the spine. Since the low back supports the upper body, it is under the most stress.

The three spinal curves between the head and the pelvis are termed the cervical lordosis, the thoraic kyphosis, and lumbar lordosis. The curves are normal when the body is standing upright with good posture. Unfortunately, these curves are changed when the body is seated. Most chairs do not give good spinal support, and back aches can develop after extended sitting periods. The distortion of these curves is due primarily to the usual chair design in which the seat slopes to the rear, and the upper back portion of the chair slants rearwardly from the portion attached to the seat.

The usual chair construction tips the superior portion of the pelvis rearwardly which reduces the lumbar lordosis, increases thoraic kyphosis, and decreases the cervical lordosis. These actions places additional stresses on the spine, causing back pain. For persons having lower back pain from an accident, the action of the chair impedes recovery and contributes to pain.

One attempt to provide a chair that will maintain the normal spine curves and alignment is the "backless" chair in which a small, independent seat portion is tipped forward, and the user's body is supported by resting the knees on a pad mounted below and forward of the seat. However, no positive support is provided for the lumbar lordosis. Thus, this chair may not be suitable for treatment of low back pain due to injuries. A device known as the Nada-Chair ® assists in supporting the lumbar lordosis with a sling-type device. A wide back pad is disposed over the lumbar region, and an adjustable looped strap is attached to each edge of the back pad, and the loops are hooked over the wearer's knees while the wearer is seated. The device increases the lumbar lordosis.

The following United States patents disclose devices believed relevant to the present invention: Bridger, U.S. Pat. No. 3.740,096 teaches a hard plastic shell type seat having a seat with a compound curved surface. Berg et al., U.S. Pat. No. 3,749,442 discloses a seat having relatively adjustable sections. Kjersem, U.S. Pat. No. 4,595,234 shows a rocking chair with a short back rest. Yeum, U.S. Pat. No. 4,696,516 describes a two piece airplane and automobile seat contured with compound seat and backrest curves. None of these references is considered to be useful for treating or relieving back pains by aligning the center of gravity of the head over the spine and pelvis.

Thus, there is a need for an insert for existing chairs and seats that will provide a positive support for the lumbar lordosis, and align the user's spine to that of the standing condition for treating and relieving low back pain.

SUMMARY OF THE INVENTION

The invention is an insert for a chair and includes a seat portion and a back portion. The insert may be formed from molded dense foam rubber, or the like. The insert may be covered with a suitable material, such as cloth, leather, or similar material. The seat portion tapers from a front edge to the rear such that the upper surface is essentially parallel with the floor when installed on a chair. The back portion has a rear surface matching the slope of the chair back, and a front surface with a lower, concave portion curved to fit the gluteal region of the user's pelvis. A central, convex portion of the front surface fits the user's lumbar curve. An upper, concave portion of the front surface matches the thoraic kyphotic curve. As will be understood, the curved regions of the back portion are formed to fit the respective regions of a user's back. An insert may be custom made for an individual, and may also be supplied in a range of heights, since an exact fit is not necessary.

A person seated on the insert has the pelvis tipped forward by the level seat with the lumbar curve being supported by the central, concave area of the back portion. The thoraic kyphotic curve of the user is supported by the anatomical curve of the upper concave area of the back portion from the inferior portion of the user's scapula. The result is that the center of gravity of the head is over the vertical axis of the spine, and directly over the pelvis. Thus the chair insert back support places the user's head, spine, and pelvis in the normal, standing configuration, relieving stress on muscles and vertebraes, and diminishes disc pressure on spinal nerves.

The chair insert back support of the invention is effective in treatment of certain etiologies of low back pain. For example, pain due to muscular weakness and disuse, and effects of acute and chronic trauma respond well to the use of the invention. To the contrary, common chair and seat designs may prevent full recovery, or lengthen the healing time in acute injuries.

It is therefore a principal object of the invention to provide a seat insert molded to provide back support for causing the user's head, spine, and pelvis to be naturally aligned as if standing.

It is another object of the invention to provide a seat insert formed to support the gluteal region, the lumbar curve, and the thoraic kyphotic curve of the user.

It is still another object of the invention to provide a chair insert for treating persons having low back pain due to muscular weakness, or trauma.

It is yet another object of the invention to provide a chair insert that positions a user's thighs level with the floor and head directly over the pelvis to cause the spine to assume a normal, standing position.

These and other objects and advantages will become apparent from the following detailed description when read in conjunction with the drawings.

DETAILED DESCRIPTION OF THE PREFERRED EMBODIMENT

Figure 1:
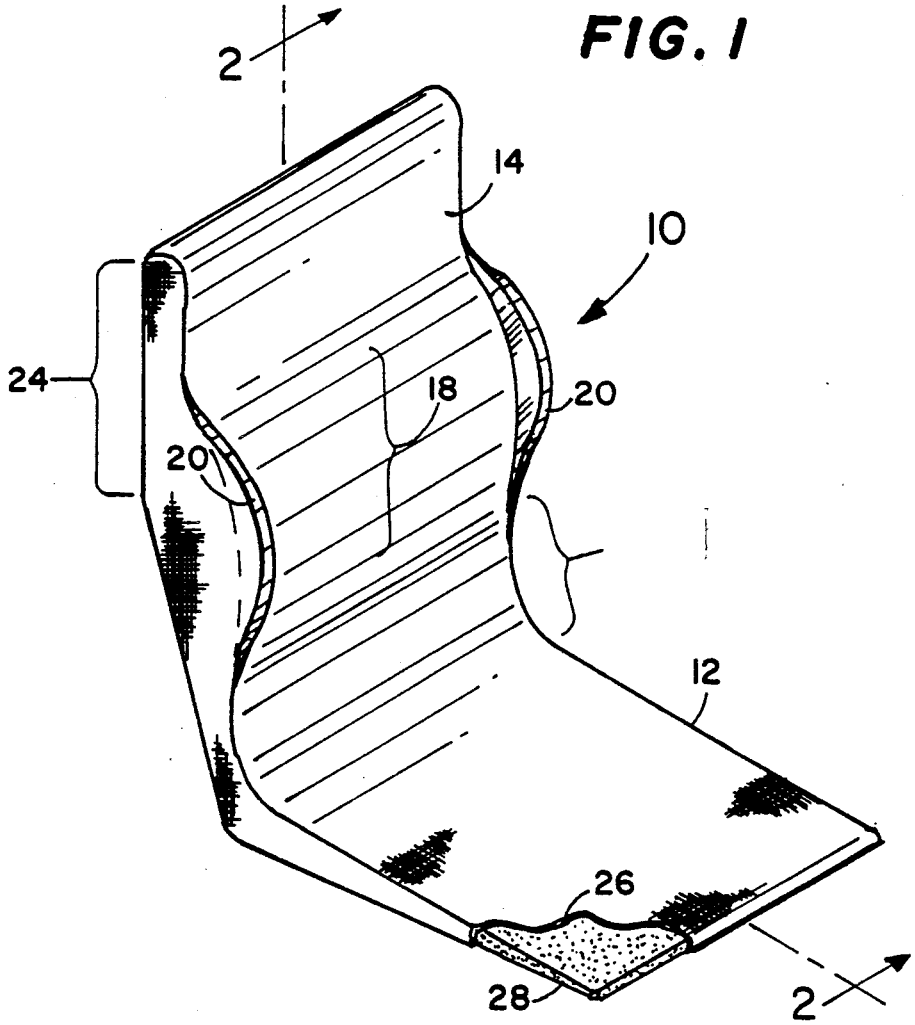
FIG. 1 is a perspective view of the chair insert of the invention.

Referring to FIG. 1 of the drawings, a perspective view of a chair insert 10, in accordance with the invention, is shown. The chair insert 10 includes a covering 26, shown having a corner portion cut away to reveal a body 28. Body 28 is formed in one piece from a resilient material such as a dense rubber foam, plastic foam, felt-like material, or similar materials. Body 28 is molded to define a tapered seat 12, a front concave region 16, a front convex region 18, a front concave region 14, and a pair of wings 20. Covering 26 may be any flexible upholstery type material such as fabric, plastic, leather, or the like.

Figure 2:
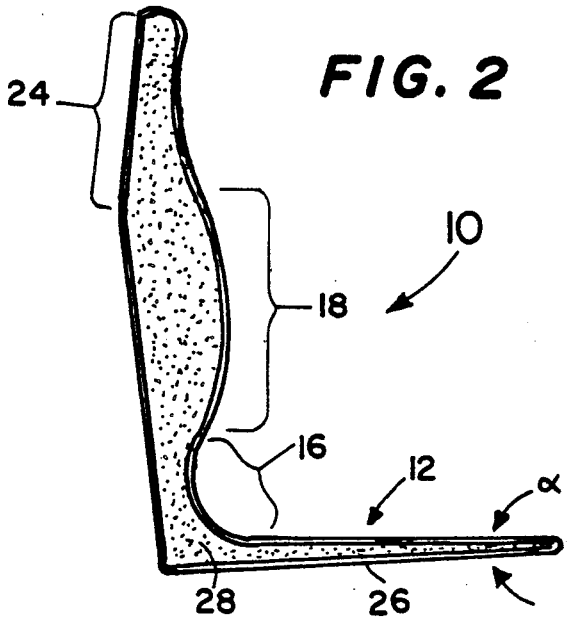
FIG. 2 is a cross section through the plane 2—2 of the chair insert of FIG. 1.

FIG. 2 provides a cross sectional view of chair insert 10 in the plane 2—2 of FIG. 1. Seat 12 is essentially wedge shaped, tapering from a front edge to the back. As will be described in more detail below, the angle is selected to match the slope of a chair seat with which the invention is to be used. Lower back surface 13 forms an angle with respect to seat 12 to match the angle of the chair back with which the chair insert 10 is to be used. Upper back surface 24 may be angled forward as discussed hereinbelow.

The front portions of chair insert 10 includes concave region 16 formed to essentially fit the gluteal region of the user. Convex portion 18 conforms essentially to the lumbar lordosis of the user, and upper back region 14 generally conforms to the thoraic kyphosis of the user. Wings 20, seen in FIG. 1, are not essential to the operation of the chair insert 10; however, these add lateral stability thereto.

Figure 3:
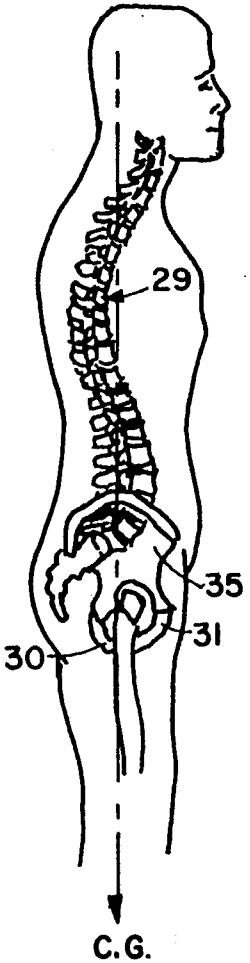
FIG. 3 is a representation of the spinal column and pelvis of a person in a standing position.

Having described the construction of the chair insert 10, the functions and use of the invention will be explained with reference to FIGS. 3–5. As discussed hereinabove, the ideal orientation of the spine is achieved when a person is standing with good posture. In FIG. 3, a standing person 40 is represented with a representation of the spinal column 29, and pelvis 35 superimposed thereon. The vertical broken line indicates the center of gravity of the person's head which is supported by spine 29. As shown, the center of gravity passes through pelvis 35, and the normal spinal curves discussed above are achieved. In this condition, spacings between vertebrae are normal with no abnormal stress occurring. When as person is being treated for back pains which may be due to bulging of discs between vertebrae, nerve pressures, trauma, or stress, this orientation minimizes such pain, and promotes healing.

Figure 4:
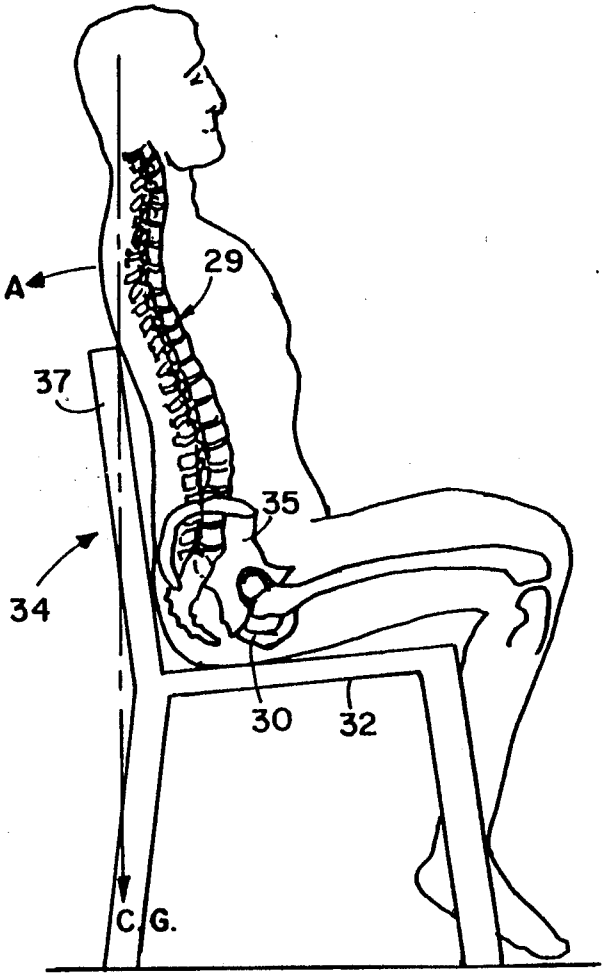
FIG. 4 is a representation of the person of FIG. 3 showing the orientation of the spinal column and the pelvis seated in a typical chair.

In FIG. 4, a typical chair 34 is shown. As will be noted, seat 32 slopes rearwardly from the horizontal, and back 37 slopes rearwardly from the vertical. When the person 40 is seated, these chair angles cause rearward rotation (arrow B) of the pelvis 35, slightly distorting the lumbar curve, and back 37 moves the person's head rearward changing the thoraic kyphosis. The rotation of the pelvis also results in the person's weight tending to be supported on the rear portion 30 of the pelvic ischium, rather than on the "sit bone" or anterior portion of the ischium 31. As will be seen, the center of gravity of the head is to the rear of the pelvis, creating pressure and stress on the vertebrae of spinal column 29. Even for normal persons, extended sitting in such position may give rise to low back pain.

Figure 5:
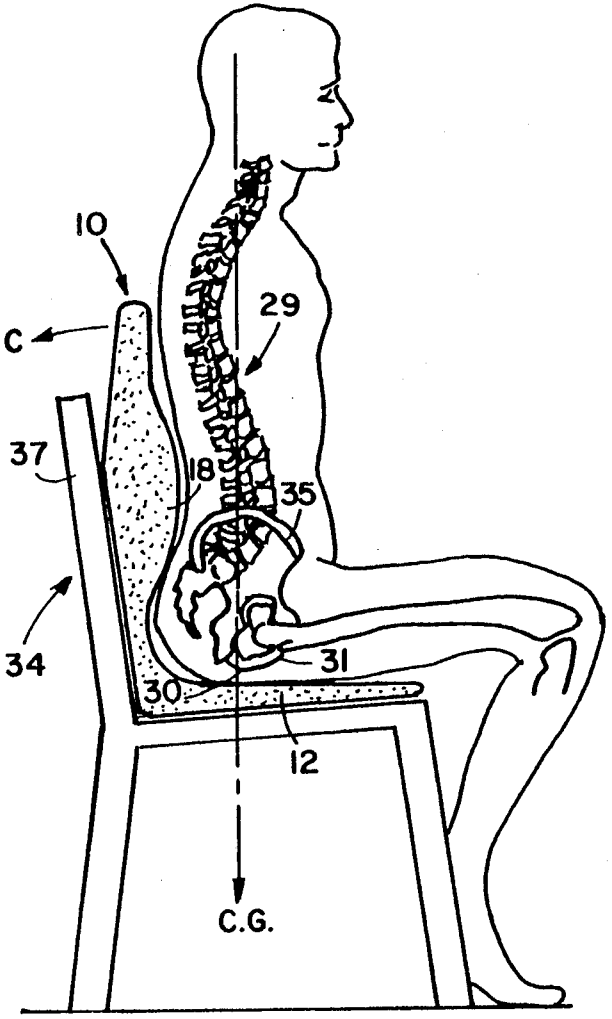
FIG. 5 is a representation of the person of FIG. 4 seated on the chair insert of the invention inserted in the chair.

The chair 34 is shown in FIG. 5 with chair insert 10 installed thereon. As will be noted, the seating surface is essentially parallel with the floor. The lumbar portion 18 of insert 10 supports lumbar curve 33. The thoracic kyphotic curve is supported by upper portion 14 to the inferior portion of the scapula. The action of insert 10 causes the person's head to be over the pelvis, and the pelvis to be oriented as in the standing position. The center of gravity of the head passes through the pelvis, permitting the vertebrae to be normal and unstressed. The person's weight is now being supported by the forward portion 31 of the ischeum.

The resilient upper portion 14 of chair insert 10 is angled forward from the chair back 37 which permits change of position of the person's upper body by rearward pressure as indicated by arrow C.

The chair insert 10 is preferably custom designed, when used as a therapeutic aid, for the height and body proportions of the patient, as well as to match the design of a particular chair. Chair insert 10 may also be made in several stock sizes. A size may be selected by an individual to obtain an approximent fit to prevent back pain when required to sit for long periods of time.

A specific example of the chair insert of the invention has been disclosed for exemplary purposes, and various modifications may be made therefrom without departing from the spirit and scope of the invention.

I claim:

1. A chair insert comprising:

a) seat portion means for providing a flat seating surface level with a floor when said chair insert is installed on a chair having a rearwardly sloping seat and backrest;

b) backrest portion including i) means for supporting a gluteal and pelvic region of a user, ii) means for supporting a lumbar curve region of a user, and iii) means for supporting a thoraic kyphotic region of a user;

c) whereby said chair insert supports the body of a user to place the center of gravity of the head of the user over the vertical axis of the spinal column and pelvis of the user.

2. A chair seat and back insert for a chair, said chair having a rearwardly sloping seat, and a rearwardly sloping back, said insert for use by a patient having an injury to the spine, comprising:

seat portion means for controlling the pelvis of a patient seated thereon to assume the position of the pelvis when the patient is in a standing position; and back support portion means, attached to said seat portion means and cooperating with said seat portion means, for supporting and controlling the lumbar curve and the thoracic kyphotic curve of the patient to cause the center of gravity of the patient's head to be over the patient's pelvis whereby the patient's vertebrae are unstressed, and whereby the patient's weight is supported by the patient's anterior ischium.

3. The insert as defined in claim 2 in which:

said seat portion means tapers from a rear edge thereof to a front edge thereof, such that an upper surface thereof is essentially parallel with a floor when installed on the seat of said chair; and said back support portion means having a lower edge thereof attached to said rear edge of said seat portion, a rear surface thereof having at least a lower portion thereof matching a slope of said back of said chair, a front surface having a lower concave portion, a central convex portion, and an upper concave portion.

4. A chair insert for supporting a body of a user to place the center of gravity of the head of the user over the vertical axis of the spinal column and pelvis of the user, comprising:

a) a seat portion having i) an essentially wedged shape, tapering from a rear edge thereof to a front edge thereof, the angle of said wedged shape selected to produce a level upper surface when installed; and b) a back portion having i) a lower edge attached to and integral with said rear edge of said seat portion, said back portion having a back surface sloping rearwardly, and ii) a front surface having a lower concave portion formed to essentially support a gluteal region of the pelvis region of a user, a central convex portion formed to support a lumbar curve region of a user, and an upper concave portion formed to support a thoraic kyphotic region of a user.

5. The insert as defined in claim 4 in which said insert is formed from a resilient material.

6. The insert as defined in claim 5 in which said material is a dense foam rubber.

7. The insert as defined in claim 4 in which said insert includes a cover.

8. A chair insert for a chair having a rearwardly sloping seat and backrest, comprising:

a seat portion having essentially flat top and bottom surfaces thereof, and tapering from a thickened rear edge thereof to a thinner front edge thereof, such that said top surface thereof is essentially parallel with a floor when installed on a chair having a rearwardly sloping seat, and a rearwardly sloping back; and a backrest portion having a lower edge thereof attached to said rear edge of said seat portion, a rear surface having at least a lower portion thereof sloping rearwardly, and a front surface having a lower concave portion, a central convex portion, and an upper concave portion;

whereby said chair insert supports the body of a user to place the center of gravity of the head of the user over the vertical axis of the spinal column and pelvis of the user.

9. The insert as defined in claim 8 in which said insert is formed from a resilient material.

10. The insert as defined in claim 9 in which said material is a dense foam rubber.

11. The insert as defined in claim 8 in which said insert includes a cover.

12. The insert as defined in claim 8 in which said seat portion and said back portion are joined in a unitary construction.

13. The insert as defined in claim 8 in which:

said lower concave portion is formed to support a gluteal region of a user's pelvis;

said central convex portion is formed to support a lumbar curve region of a user; and said upper concave portion is formed to support a thoraic kyphotic region of a user.

14. The insert as defined in claim 13 which further includes a pair of stabilizing wings projecting from lateral edges of said central convex portion.

* * * * *